United States Patent [19]

Petterson et al.

[11] 4,128,143

[45] Dec. 5, 1978

[54] SUPERVISORY CONTROL MEANS FOR AUTOMATIC ELEVATOR SYSTEMS

[76] Inventors: Leif J. Petterson, 1164 Hartford Tpke., North Haven, Conn. 06473; Leif E. Petterson, 89 Janeway Dr., Guilford, Conn. 06437

[21] Appl. No.: 810,521

[22] Filed: Jun. 27, 1977

[51] Int. Cl.[2] ..... B66B 1/46

[52] U.S. Cl. ..... 187/29 R

[58] Field of Search ..... 187/29

[56] References Cited

U.S. PATENT DOCUMENTS

| | | | |
|---|---|---|---|
| 3,297,109 | 1/1967 | Magee | 187/29 |
| 3,388,376 | 6/1968 | Magee | 187/29 |
| 3,726,364 | 4/1973 | Citrin et al. | 187/29 |
| 3,773,145 | 11/1973 | Drexler | 187/29 |
| 3,788,428 | 1/1974 | Fried | 187/29 |
| 3,971,885 | 7/1976 | Kito | 187/29 |

*Primary Examiner*—Robert K. Schaefer
*Assistant Examiner*—W. E. Duncanson, Jr.
*Attorney, Agent, or Firm*—James A. Coles

[57] ABSTRACT

A modular supervisory control means for overriding normal operation modes of automatic elevator systems has the versatility of being stationed anywhere in proximity to the elevator system. The supervisory control means is physically separated from the predetermined control circuit of the elevator system and includes a plurality of relays each having an electrical input and outputs, a first group of terminals electrically coupled to the inputs and outputs of the relays, a second group of terminals at least some of which are electrically coupled to the predetermined control circuit of the elevator system, and interconnecting means for electrically coupling at least some terminals of the first group of terminals to at least some terminals of the second group of terminals whereby the supervisory control means is readily adaptable to supervise as many normal modes of operation as desired of any elevator system in response to an electrical signal.

12 Claims, 2 Drawing Figures

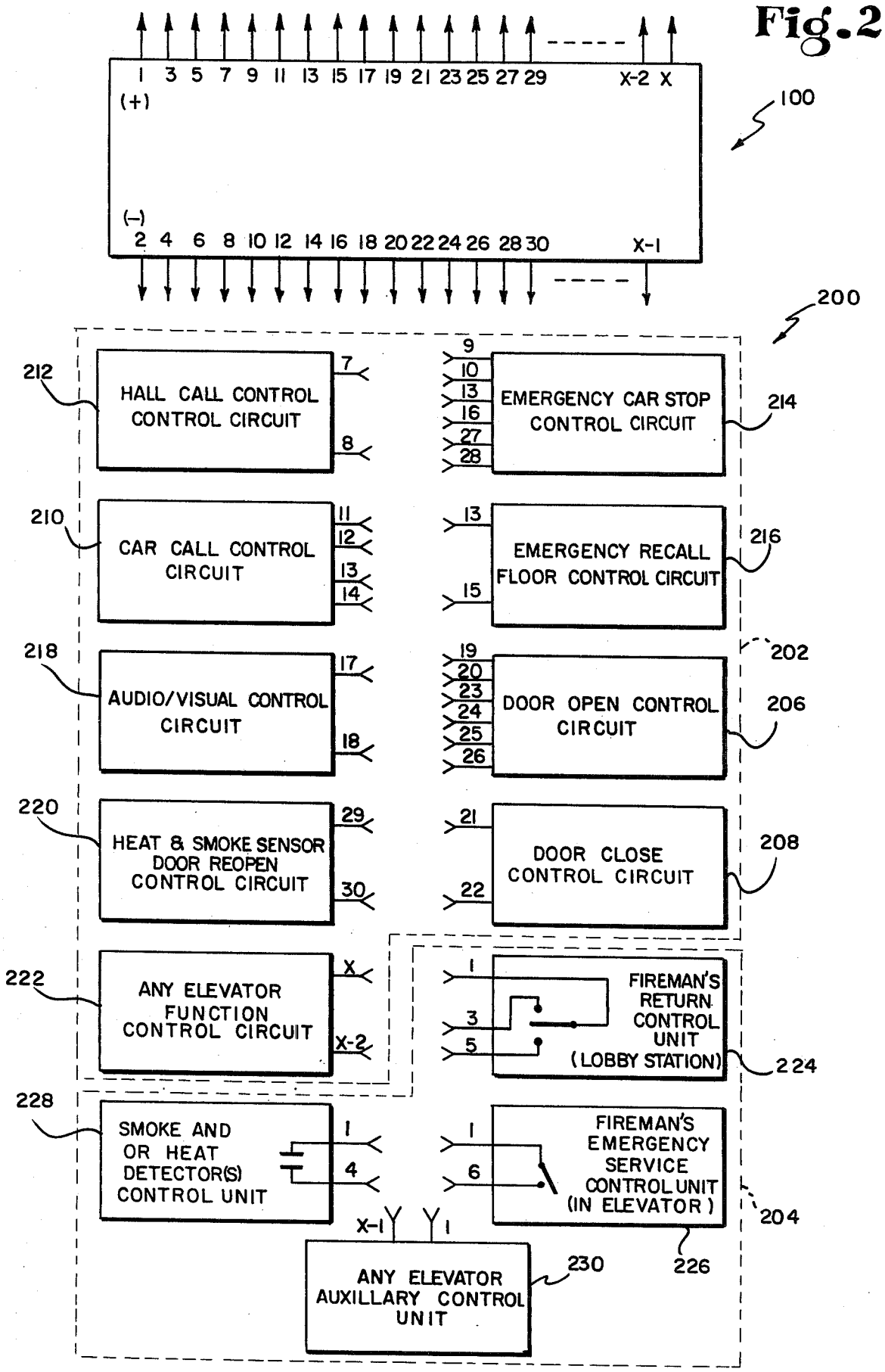
Fig. 2
1 3 5 7 9 11 13 15 17 19 21 23 25 27 29 X-2 X
(+)
(−)
2 4 6 8 10 12 14 16 18 20 22 24 26 28 30 X-1
100
200
212
HALL CALL CONTROL CONTROL CIRCUIT
7
8
9
10
13
16
27
28
EMERGENCY CAR STOP CONTROL CIRCUIT
214
210
CAR CALL CONTROL CIRCUIT
11
12
13
14
13
15
EMERGENCY RECALL FLOOR CONTROL CIRCUIT
216
218
AUDIO/VISUAL CONTROL CIRCUIT
17
18
19
20
23
24
25
26
DOOR OPEN CONTROL CIRCUIT
202
206
220
HEAT & SMOKE SENSOR DOOR REOPEN CONTROL CIRCUIT
29
30
21
22
DOOR CLOSE CONTROL CIRCUIT
208
222
ANY ELEVATOR FUNCTION CONTROL CIRCUIT
X
X-2
1
3
5
FIREMAN'S RETURN CONTROL UNIT (LOBBY STATION)
224
228
SMOKE AND OR HEAT DETECTOR(S) CONTROL UNIT
1
4
1
6
FIREMAN'S EMERGENCY SERVICE CONTROL UNIT (IN ELEVATOR)
204
X-1
1
ANY ELEVATOR AUXILLARY CONTROL UNIT
230
226

SUPERVISORY CONTROL MEANS FOR AUTOMATIC ELEVATOR SYSTEMS

BACKGROUND OF THE INVENTION

1. Field of the Invention

This invention relates generally to automatic elevator systems and in particular to means for providing supervisory control of normal operation modes of such elevator systems in response to an electrical signal.

2. Description of the Prior Art

In conventional automatic elevator systems a preconditioned control circuit means is provided to control the normal operation modes of the elevator. Regardless of how old an existing system may be, normal operation modes of elevator systems usually include the servicing of a plurality of reference floor levels by at least one car, the responding of such car to both hall call registers and car call registers, and the automatic opening and closing of at least one car door at each reference floor for which a call has been registered. Although these operations appear to be universal normal operations for elevator systems, it will be understood by those skilled in the art that an elevator system may include additional normal operation modes for which the control circuit means will have been preconditioned to control.

Recent events which have occurred in automatic elevator systems during emergency situations have resulted in legislation and new safety codes which require that all automatic elevator systems, both old and new, operate in certain abnormal operation modes when an emergency situation arises (See The American National Standards Institute's Safety Code for Elevators, ANSI A17.1, Section 211, 1973 and 1976 Supplements Thereto). Furthermore, even without legislation, it has become desirable to incorporate additional operation modes to update existing automatic elevator systems and to provide other safety features not necessarily required by any safety code or law. Many control circuits have been devised in order to implement added features to the normal operation modes of elevator systems of which U.S. Pat. Nos. 3,297,109; 3,726,364; 3,773,145, and 3,788,428 are exemplary. Naturally, these new control circuits require the incorporation of additional circuitry to the existing preconditioned control circuit means of each elevator system which is being modified in order to cause the elevator to operate in the desired abnormal operation mode in response to an electrical signal. Typically, modifying the preconditioned control circuit means has involved electrically coupling and mounting individual switching devices to the preconditioned control circuit means.

The incorporation of additional circuitry to modify the preconditioned control circuit means of elevator systems does not present any special problems if accomplished at the time of assembly of new preconditioned control circuit means; however, the incorporation of such additional circuitry into existing control circuit means does present problems due to the lack of space, remote locations of individual controls, and the variety of preconditioned control circuit means. Many existing automatic elevator systems are very old systems and very few have identical circuitry for controlling the normal operations of the elevator. In most instances where new and old elevator systems are required by law to incorporate circuitry which will cause them to operate as the law prescribes considerable time must be spent to incorporate individual switcing devices into each elevator system because of the problems enumerated above. There exists no universal means for providing additional supervisory circuitry to the large variety of preconditioned control circuit means of existing elevator systems. While it will be recognized by those skilled in the art that the present invention is most advantageously adaptable to existing automatic elevator systems it will also be recognized that the modular construction of the supervisory control means of the present invention allows it to be advantageously used in the manufacture and assembly of new elevator systems where laws require elevator systems to operate in certain abnormal modes under emergency conditions, since the supervisory control circuitry required to cause such abnormal operations will be integrated into a single module allowing for easy installation and maintenance of the added circuitry.

The modular supervisory control means of the present invention actually compliments those previously devised control circuits represented by the aforementioned U.S. patents for supervising the normal operation modes of an elevator system. Accordingly, the present invention is distinguishable from the U.S. patents cited above in that the present invention does not encompass any particular supervisory control circuit but rather is a universal means for providing a supervisory control circuit to an automatic elevator system.

SUMMARY OF THE INVENTION

In accordance with the present invention in its broadest concept there is provided a modular control means for providing supervisory control over normal operation modes of elevator systems.

It is an object of the present invention to provide a supervisory control means which is modularized such that it may be stationed anywhere in proximity to an elevator system.

It is yet another object of the present invention to provide a modular supervisory control means which may be adapted universally to any automatic elevator system to provide a plurality of abnormal elevator operation modes in response to an electrical signal.

It is another object of the present invention to provide a modular supervisory control means which is movable and physically separated from the normal control circuit means of an elevator system.

It is still yet another object of the present invention to provide a modular supervisory control means which is versatile, easily accessible, and maintainable.

It is yet another object of the present invention to provide a modular supervisory control means which may supervise a plurality of operation modes from a single integrated control module and which is expandable for future supervisory control circuitry.

It is another object of the present invention to provide in combination with an automatic elevator system, the improvement which includes a supervisory control means physically separated from the normal control circuit means of the elevator system for overriding at least one normal mode of operation of the elevator system in response to an electrical signal wherein the supervisory control means includes a plurality of switching devices each having an electrical input and outputs, a first group of terminals electrically coupled to the inputs and outputs of the switching devices, a second group of terminals at least some terminals of which are electrically coupled to the normal control circuit means, and interconnecting means for electrically coupling at least some terminals of the first group of terminals to at least some terminals of the second group of terminals whereby the supervisory control means is readily adaptable to supervise as many normal modes of operation as desired of any elevator system.

It is yet another object of the present invention to provide an improved method of modifying a preconditioned control circuit of an automatic elevator system to supervise a plurality of normal modes of operation of the elevator system wherein the improvement includes electrically coupling various portions of the preconditioned control circuit to a single modular supervisory control means physically separated from the preconditioned control circuit whereby a plurality of normal modes of operation are supervised by a single module in response to an electrical signal.

These and other features of the invention will become more apparent from the following description taken in conjunction with the accompanying drawings which follow:

BRIEF DESCRIPTION OF THE DRAWINGS

FIG. 2 is a block diagram showing the adaptation of a supervisory control means in accordance with the present invention to an elevator system.

DESCRIPTION OF THE PREFERRED EMBODIMENT

Figure 1:
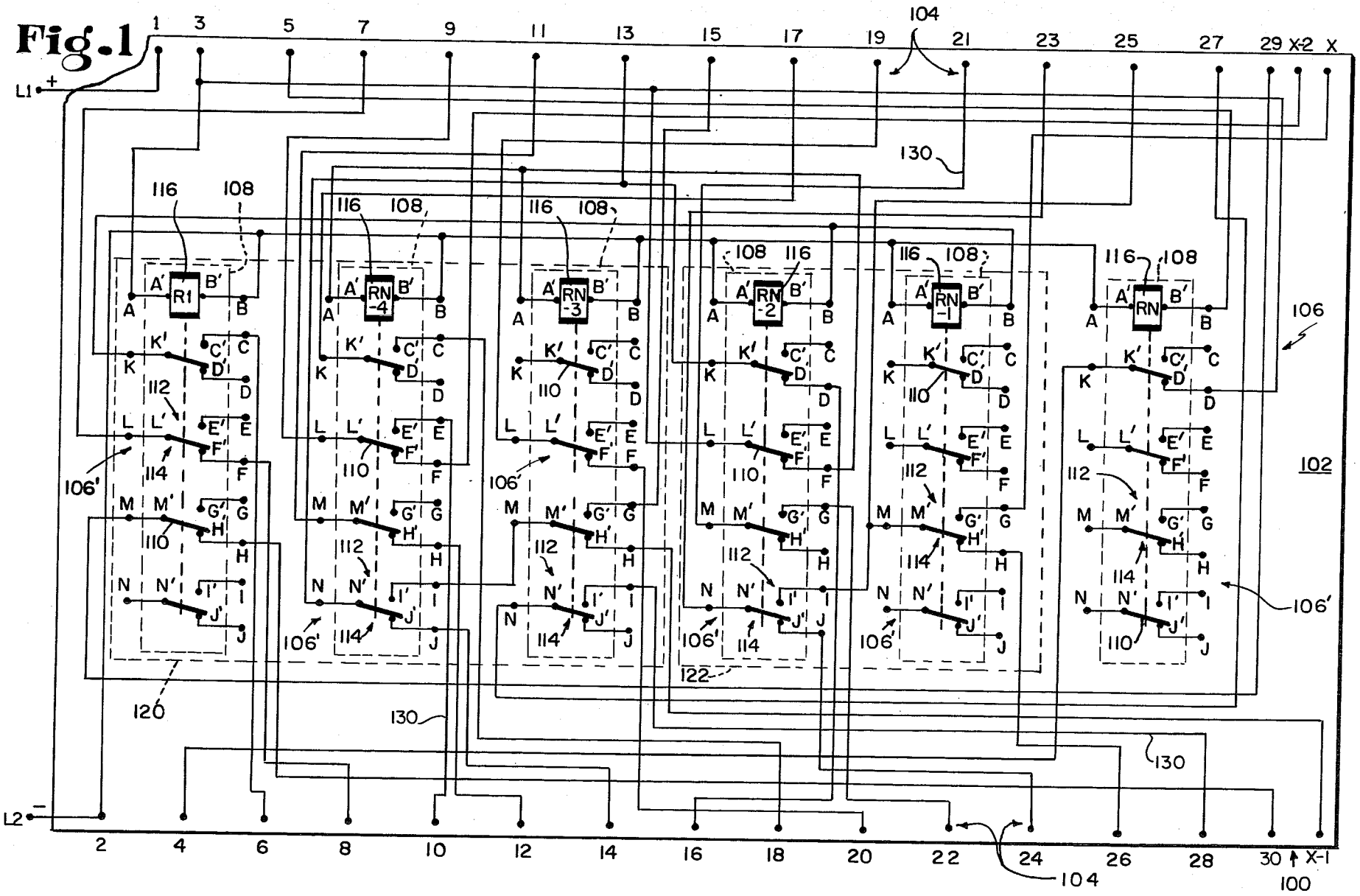
FIG. 1 is an exemplary schematic diagram of a supervisory control means of the present invention.

Referring now to FIG. 1 there is shown an exemplary schematic diagram of a supervisory control means of the present invention. The schematic diagram of FIG. 1 is only an example of how the supervisory control means of the present invention may be electrically coupled for adaptability to a plurality of elevator systems and is not intended to limit the invention to the schematic arrangement as shown. It will be obvious to one skilled in the art that the number of ways that the supervisory control means of the present invention may be electrically coupled and subsequently adapted to an elevator system is virtually unlimited.

As shown in FIG. 1, a supervisory control means 100 of the present invention includes a modular substratum 102 which is mountable, a plurality of terminals which are disposed on the substratum 102 and which include at least two groups of terminals 104 and 106, a plurality of switching devices 108 each having an electrical input A′ or B′ and outputs C′ through N′ which are electrically coupled to a first group of terminals 106, a second group of terminals 104 at least some terminals of which are electrically coupled to a normal control circuit means 200 (FIG. 2) of an elevator system, and interconnecting means 130 for electrically coupling at least some terminals of the first group of terminals 104 to at least some terminals of the second group of terminals 106.

It will be understood that the substratum 102 may be made of any type of material; however, in the preferred embodiment the material would comprise an insulative material. It will also be understood that since the substratum 102 is a single module, it may be mounted in a container such as a box and that such box may in turn be mounted anywhere in proximity to the elevator system.

The first group of terminals 106 includes a plurality of subgroups of terminals 106′ with each subgroup 106″ having individual terminals A through N. As shown in FIG. 1, there will be as many subgroups of terminals 106′ as there are switching devices 108. In the preferred embodiment of supervisory control means 100 each subgroup of terminals 106′ is a Multi-Pin Square-Base Miniature Socket Assembly of the type which is manufactured by Curtis Industries, Inc. of Milwaukee, Wis. Each Socket Assembly has a plurality of terminals A through N and pin receptacles represented by the inputs and outputs A′ through N′ of switching devices 108 (FIG. 1) to accept pins (inputs and outputs) of miniature switching devices 108. Furthermore, when a switching device 108 is plugged into a socket assembly each input and output A′ through N′ through a pin receptacle is electrically coupled within the socket assembly to a terminal A through N.

The second group of terminals 104 may include any conventional means for terminating an electrical conduit 1 through X. Preferrably the terminals 1 through X of the second group of terminals 104 should be arranged on the substratum 102 such that electrical conduits electrically coupling the normal control circuit means 200 to the control means 100 may be conveniently terminated thereby. The terminals 1 through X should also have the ability to electrically couple external electrical conduits to internal interconnecting means 130 such that an electrical signal may be transmitted from the external conduits to the interconnecting means 130 and vice versa.

In the preferred embodiment, switching devices 108 are miniature relays R1 through RN of the type which are manufactured by Guardian Electric Manufacturing Co. of Chicago, Ill. having plug-in termination pins representing inputs and outputs A′ through N′ of the relays. The plug-in termination pins of each relay are plugged into the pin receptacles of a socket assembly thereby allowing easy and quick replacement of the relay upon its failure to properly operate without necessitating the uncoupling of interconnecting means 130. It is not intended that the present invention necessarily be limited to the number of relays shown in FIG. 1 and therefore any number RN of relays may be coupled to any number of subgroups of terminals 106′ to accomplish supervisory control of as many operation modes of an elevator system as desired. Each relay R1 through RN includes a plurality of movable contacts 110 each having a normally open state 112 and a normally closed state 114. When an electrical signal is received by a solenoid 116 through an electrical input A′ or B′ of any of the relays R1 through RN each of the normally open states 112 and normally closed state 114 of the relay are caused to close and open respectively.

Referring now to FIG. 2 the supervisory control means 100 of the present invention is shown as it may be adapted to override various normal modes of operation of a universal elevator system. As shown, elevator systems universally include a normal or preconditioned control circuit means 200 having a plurality of control circuits 202 and a plurality of auxillary control units 204 which in conjunction with the control circuits 202 control various normal operation modes of the elevator system. Supervisory control means 100 as illustrated is physically separated from normal control circuit means 200 such that the supervisory control means may be mounted anywhere within proximity of the elevator system. It will be obvious to those skilled in the art that not all elevator systems have the same normal operation modes; however, elevator systems in general function in a manner whereby at least one car services a plurality of floors in response to call registers, and at least one door of the car opens and closes at each reference floor level.

Accordingly, all elevator systems will have a door open control circuit 206, a door close control circuit 208, a hall call control circuit 212, and a car call control circuit 210. Some elevator systems may in addition have an emergency car stop control circuit 214, an emergency recall floor control circuit 216, an audio/visual control circuit 218, a heat and smoke sensor door reopen control circuit 220, and a variety of other elevator function control circuits 222 which control normal operation modes of the elevator. The number of control circuits that may exist in any given normal control circuit means of an elevator system is by no means limited to the control circuits shown in FIG. 2 and as described hereinabove; therefore it is not intended that the present invention be limited to its adaptability to a normal control circuit means having only those control circuits shown in FIG. 2. Additionally, elevator systems necessarily include auxillary control units 204 for implementing normal and abnormal operation modes of the elevator. Again by way of example, there are shown in FIG. 2 a smoke and/or heat detector control unit 228, a fireman's return control unit 224, a fireman's emergency service control unit 226, and the representation of any other elevator auxillary control unit 230. As before, it is not intended that the adaptability of the present invention be necessarily limited to a normal control cirucit means having only those auxillary control units shown in FIG. 2.

Referring now to FIGS. 1 and 2, the operation of the present invention can best be described by way of an example of its adaptation to an existing elevator system which includes a normal or preconditioned control circuit means 200 as shown in FIG. 2. Accordingly, the operation of supervisory control means 100 will be described hereinafter with respect to its use in providing what is generally termed "Fireman's Return" and "Fireman's Emergency Service." Briefly, "Fireman's Return" and "Fireman's Emergency Service" are terms used in the elevator art (See American National Standards Institute's Safety Code for Elevators) to describe certain abnormal modes of operation which an elevator system must be capable of performing in response to an emergency condition. More specifically, control means for "Fireman's Return" and "Fireman's Emergency Service" must be capable of overriding certain normal operation modes of the elevator system so that they operate abnormally in response to an emergency signal. Furthermore, it is required that "Fireman's Return" be in operation as a condition precedent to the operation of "Fireman's Emergency Service."

Referring to FIG. 1, certain relays R1, RN-4 and RN-3 may be utilized to provide abnormal modes of operation for "Fireman's Return" (represented by block 120), certain relays RN-2 and RN-1 may be utilized to provide abnormal modes of operation for "Fireman's Emergency Service" (represented by block 122), and a relay RN may be utilized to provide a by-pass system to return an elevator system to normal operation modes where a false emergency signal has been received. As shown in FIG. 1, power lines L1 and L2 of an elevator system are electrically coupled to terminals 1 and 2 of the second group of terminals 104. Since it is intended that supervisory control means 100 only provide supervisory control in response to an electrical signal indicating an emergency condition, auxilliary control units such as 224, 226, 228, and 230 are electrically coupled between terminal 1 and any other terminals 3 through X such that any one of the relays R1 through RN will only respond when an electrical signal is received from one of these control units. Furthermore, since it is desirable that "Fireman's Emergency Service" only be operable if "Fireman's Return" is operable, a relay RN-2 of "Fireman's Emergency Service" is conditioned by electrically coupling the B terminal (input B') of relay RN-2 to the K terminal (normally open state 112) of relay R1 to respond to the closing of a normally open state 112 of a relay of "Fireman's Return" R1 when relay R1 is activated through its electrical input A' in response to an emergency signal.

FIG. 1 shows that as many of the terminals A through N of each subgroup of terminals 106' as desired may be either electrically coupled to other terminals A through N of other subgroups 106' or electrically coupled to terminals 1 through X of the second group of terminals 104 by interconnecting means 130. It can therefore be seen that by electrically coupling the various groups and subgroups of terminal means as described above, any combination of normally open states 112 and/or normally closed states 114 of relays R1 through RN are available at selected terminals 1 through X to be electrically coupled to various control circuits 202 and control units 204 of a normal control circuit means 200 whereby the normal operation modes of an elevator system are supervised by a single module 100.

Because of the numerous combinations of normally open states 112 and/or normally closed state 114 that are available at selected terminals 1 through X, supervisory control means 100 is adaptable to any elevator system. If the supervision of a normal operation mode of a control circuit 202 will require a normally open state 112 during normal operation which should close in response to an electrical signal when the operation mode is to operate abnormally, then terminals such as 21 and 22 as shown in FIG. 1 should be selected to be electrically coupled to the specific control circuit 208 of the elevator system which controls such normal operation mode (See FIG. 2). As previously indicated, control circuit 208 may be entirely different for each elevator system and the normal operation mode controlled by such control circuit 208 for one elevator system may be abnormal to the normal operation mode controlled by such control circuit 208 for another elevator system. However, the modular supervisory control means 100 of the present invention is adaptable to either of such elevator systems to provide supervisory control of the normal operation mode.

What we claim is:

1. In combination with an automatic elevator system of the type which includes at least one car servicing a plurality of floors, said car having at least one door which opens and closes, and normal control circuit means for controlling various normal modes of operation of said elevator system, the improvement which comprises: a supervisory control means physically separated from said normal control circuit means for overriding at least one normal mode of operation of said elevator system in response to an electrical signal, said supervisory control means including a plurality of switching devices each having an electrical input and outputs, a first group of terminals electrically coupled to said inputs and outputs of said switching devices, a second group of terminals at least some terminals of which are electrically coupled to said normal control circuit means, and interconnecting means for electrically coupling at least some terminals of said first group of terminals to at least some terminals of said second group of terminals whereby said supervisory control means is readily adaptable to supervise as many normal modes of operation as desired of any elevator system.

2. The control means as recited in claim 1 wherein at least some terminals of said first group of terminals are electrically coupled to at least some other terminals of said first group of terminals whereby supervision of at least one normal mode of operation by said supervisory control means is responsive to supervision of at least another normal mode of operation by said supervisory control means.

3. The control means as recited in claim 2 wherein said switching devices are electromechanical switching devices having a plurality of movable contacts.

4. The control means as recited in claim 3 wherein said electromechanical switching devices are relays each having a plurality of normally closed states and a plurality of normally open states which are caused to open and close respectively in response to said electrical signal.

5. The control means as recited in claim 4 wherein each of said outputs of each of said relays corresponds to at least one of said normal states.

6. The control means as recited in claim 4 wherein said first group of terminals includes a plurality of subgroups of terminals and each subgroup of terminals includes a multi-pin receptacle socket assembly having at least as many terminals as pin receptacles.

7. The control means as recited in claim 5 wherein said relays have termination pins for at least each of said normal states and said termination pins are coupled to said pin receptacles of said relay socket assemblies.

8. The control means as recited in claim 7 wherein said supervisory control means is a single module which is mountable anywhere in proximity to said elevator system.

9. In a method of modifying a preconditioned control circuit of an automatic elevator system to supervise a plurality of normal modes of operation of said elevator system wherein a plurality of switching devices are individually electrically coupled and mounted to various portions of said preconditioned control circuit; the improvement which comprises: electrically coupling said various portions of said preconditioned control circuit to a single modular supervisory control means physically separated from said preconditioned control circuit whereby a plurality of normal modes of operation are supervised by a single module in response to an electrical signal.

10. The improved method as recited in claim 9 wherein said supervisory control means includes a plurality of switching devices each having an electrical input and outputs, a first group of terminals electrically coupled to said inputs and outputs of said switching devices, a second group of terminals at least some terminals of which are electrically coupled to said preconditioned control circuit, and interconnecting means for electrically coupling at least some terminals of said first group of terminals to at least some terminals of said second group of terminals.

11. The improved method as recited in claim 10 wherein at least some terminals of said first group of terminals are electrically coupled to at least some other terminals of said first group of terminals.

12. The improved method as recited in claim 11 wherein said supervisory control means is housed in a container which is mountable anywhere in proximity to said elevator system.

* * * * *